US008220304B2

(12) United States Patent
Etienne

(10) Patent No.: US 8,220,304 B2
(45) Date of Patent: Jul. 17, 2012

(54) MACHINE FOR CAMBERING, FORMING, FOLDING OR BENDING BARS, WIRES OR EXTRUDED SHAPES

(75) Inventor: Joël Etienne, Saint Die des Vosges (FR)

(73) Assignee: Numalliance, Saint Michel sur Meurthe (FR)

( * ) Notice: Subject to any disclaimer, the term of this patent is extended or adjusted under 35 U.S.C. 154(b) by 569 days.

(21) Appl. No.: 12/091,044

(22) PCT Filed: Sep. 28, 2006

(86) PCT No.: PCT/FR2006/002197

§ 371 (c)(1),
(2), (4) Date: Apr. 21, 2008

(87) PCT Pub. No.: WO2007/048893

PCT Pub. Date: May 3, 2007

(65) Prior Publication Data

US 2008/0295559 A1 Dec. 4, 2008

(30) Foreign Application Priority Data

Oct. 28, 2005 (FR) ..... 05 11016

(51) Int. Cl.
*B21D 7/04* (2006.01)
*B21D 9/05* (2006.01)

(52) U.S. Cl. ..... 72/149; 72/389.1

(58) Field of Classification Search ..... 72/149–159, 72/386, 389.1

See application file for complete search history.

(56) References Cited

U.S. PATENT DOCUMENTS

| | | | | |
|---|---|---|---|---|
| 2,389,937 | A * | 11/1945 | Schmitt | 72/150 |
| 4,206,629 | A * | 6/1980 | Grimaldo | 72/389.1 |
| 4,833,907 | A * | 5/1989 | Grimaldo | 72/157 |
| 4,888,971 | A * | 12/1989 | Schwarze | 72/157 |
| 6,155,091 | A | 12/2000 | Hayes et al. | |
| 2003/0205074 | A1 | 11/2003 | O'Donnell et al. | |

* cited by examiner

*Primary Examiner* — Teresa M Ekiert
(74) *Attorney, Agent, or Firm* — Egbert Law Offices PLLC

(57) ABSTRACT

The invention concerns a machine for cambering, forming, folding or bending a bar, a wire or an extruded shape. The invention includes a bending form provided with a clamping system, a device for orienting the tube, and a bending jaw (8). The bending jaw is prismatic and machined to the tube radius on at least one of its surfaces. The kinematics of the displacement of the bending jaw in a peripheral area at the bending form is provided by any combination of at least two, rectilinear or rotating, movements. The bending jaw is steerable in rotation about a median axis perpendicular to the bending plane. The bending jaw is mobile in the vertical direction to provide multiple bending operations.

7 Claims, 7 Drawing Sheets

MACHINE FOR CAMBERING, FORMING, FOLDING OR BENDING BARS, WIRES OR EXTRUDED SHAPES

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to a machine for cambering, forming, folding or bending bars, wires or section pieces.

2. Description of Related Art Including Information Disclosed Under 37 CFR 1.97 and 37 CFR 1.98

Chairs, driers, light fittings, display stands and numerous objects are produced from bars, tubes or section pieces that are bent or folded into complex shapes, sometimes in all three dimensions. These shapes are produced by means of bending machines which deform the elements without breaking them, keeping crushing to a minimum.

These bending machines are becoming increasingly sophisticated in order to produce components of ever increasing complexity, repeatably, with automation, and at high production rates.

It is often necessary to perform two or even more bending operations in different planes on a tube, bar or section piece, and this is achieved by disengaging the tube after each stage and then repositioning it, having pivoted it axially.

Conventionally, bending machines have different bending heads for producing three-dimensional deformations of the elements in two or more stages as need be. With a view to fully automating these machines, it is absolutely essential for the element that is to be deformed to be repositioned in the machine after each bending operation, and this operation is performed by orienting heads positioned between the bending elements or by bending heads that allow numerous deformations, such as those described in the applicant company's document EP 1 272 293.

In many cases it is desirable to deform tubes, wires, section pieces or bars in several planes and in an optimum manner without them having to be repositioned by an orienting device which leads to potential problems of positioning them in the machine. Bending machines of the prior art conventionally are of two types, draw bending machines and compression bending machines.

These two categories of machine, which will be described later on in the description, have common shortcomings:

- the bending jaw in the machine often marks the tube,
- it is difficult to perform multiple bending operations when the distances between bends are very short or even zero,

- it is impossible to produce parts the bent portions of which interfere with the machine or the tooling as a result of there being just one direction of bending, and
- it is difficult to perform bending operations on tubes that have accessories attached to their perimeter.

It is therefore an objective of the invention to resolve these main difficulties by proposing a bending machine that has a bending head of a novel type.

BRIEF SUMMARY OF THE INVENTION

The present invention relates to a machine for cambering, forming, folding or bending a tube, a bar, a wire or a section piece comprising a bend die provided with a clamping system, with a device for orientating the tube and with a bending jaw. The bending jaw is prismatic and machined to the diameter of the tube on at least one of its faces. The dynamics governing the movement of the bending jaw in an area peripheral to the bend die is brought about by any combination of at least two movements, rectilinear or rotary. The bending jaw can be oriented in terms of rotation about a central axis perpendicular to the bending plane. The bending jaw is able to move in the vertical direction to allow the tube that is to be bent to be positioned to the right or to the left, and several shapes or diameters to be superposed.

The bending jaw can be moved in an area peripheral to the bend die so that it can press against the tube that is to be bent in numerous configurations.

The bending machine according to the invention possesses numerous advantages:

- it is possible to bend a tube in both directions within the same part,
- one and the same part can be manufactured with large-angle bends, small-angle bends and short segments,
- accessories present on the part do not prevent it from being bent,
- the surface of a delicate part, for example one made of light alloy, tube or section piece, is not marked,
- the quality of bending is excellent, and this is true of all envisioned configurations.

Further features and advantages of the invention will become apparent from the description which will follow with reference to the attached drawings which are given purely by way of nonrestrictive examples.

DETAILED DESCRIPTION OF THE INVENTION

For ease of reading, the following description employs the term "tube" generically to denote a part that may be a bar, a wire, a section piece, or a tube before it has been bent.

For ease of depiction in FIGS. 19 to 27, the movements are shown in a horizontal plane, although these embodiments can of course be reproduced in any working plane.

In the conventional way, a bending machine according to the invention comprises a support structure supporting the bend die, a clamping device for holding the tube throughout the forming operation and a tube orienting device. To make the invention easier to understand, FIGS. 3 to 28 provide a schematic depiction of only the essential elements of the machine, namely the bend die and the bending jaw.

Figure 1:
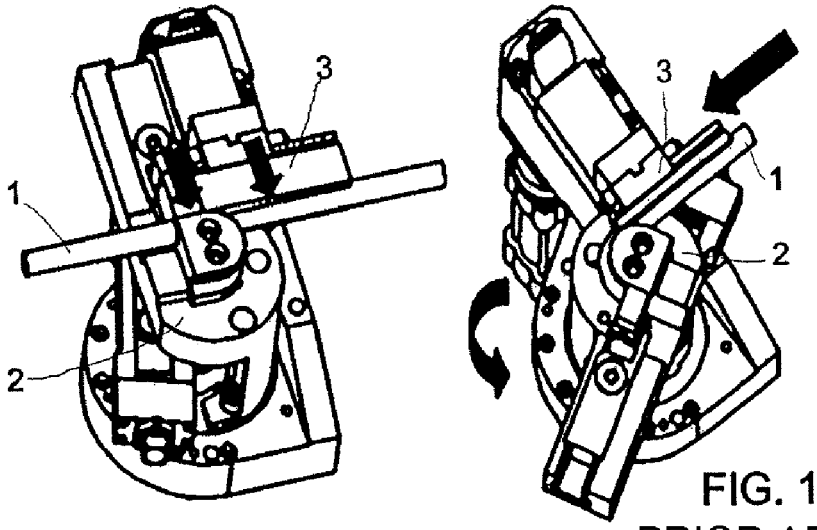
FIG. 1 PRIOR ART
FIG. 1 depicts a perspective view of draw bending machine according to the known prior art.
Figure 2:
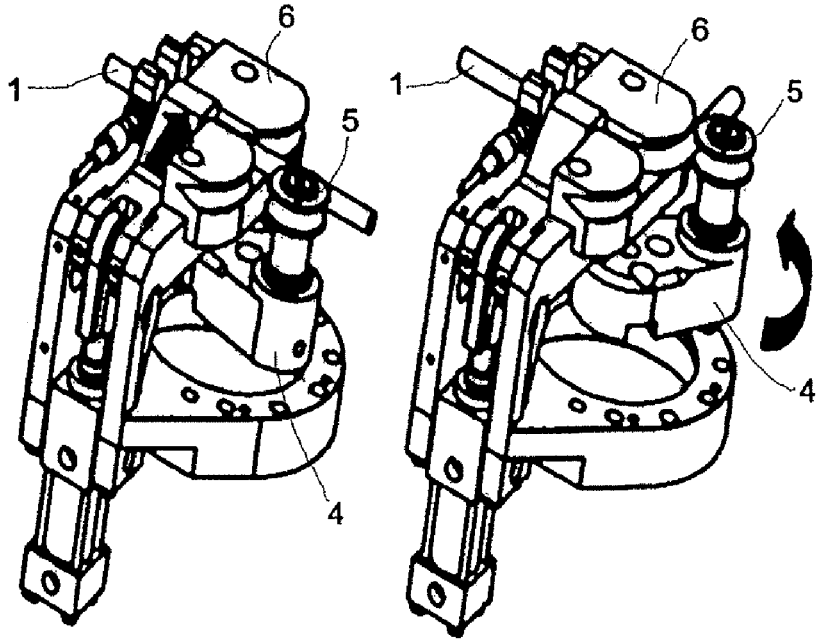
FIG. 2 PRIOR ART
FIG. 2 illustrates a perspective view of a compression bending machine according to the known prior art.

The prior art in the field of bending is known in two main forms: the "draw bending" technique depicted in FIG. 1 and the "compression bending" technique illustrated in FIG. 2.

In the "draw bending" technique, the tube 1 is clamped on the bend die 2 and rotated thereby, the tube 1 being held in place during bending by a work rest 3 that may be fixed or sliding.

This machine displays several disadvantages. For short segments between bends, the jaw has to be machined to the shape of the previous bend. The bending head is a one way head and bending can therefore be performed only in either of the clockwise direction or the counterclockwise direction. Also, the jaw that is supposed to prevent the tube from slipping during bending may mark this tube, particularly in the case of light alloys.

In the "compression bending" technique, a depiction of which is provided in FIG. 2, the tube 1 is clamped to the fixed part and a moving member borne by the head 4, for example a roller 5, winds the tube over the fixed die 6.

Just as in the previous technique, short segments between bends are difficult or impossible to achieve and the roller that rotates during bending often marks the tube.

Figure 3:
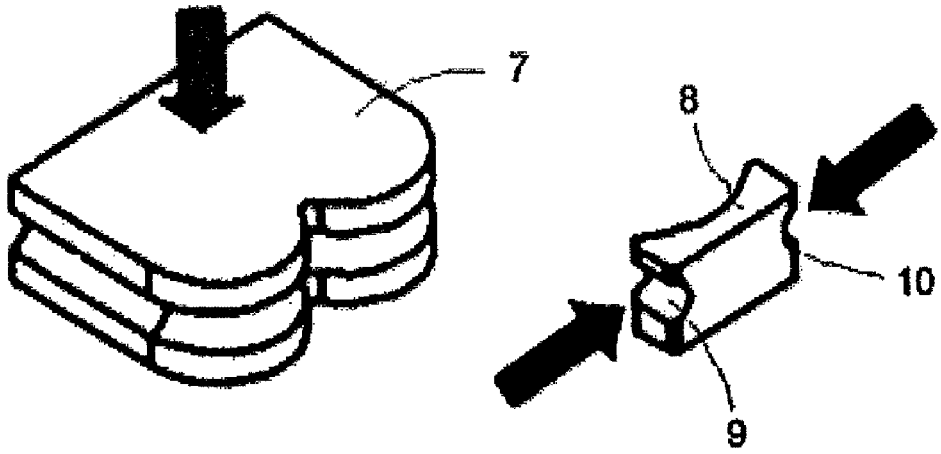
FIG. 3 illustrates a perspective view of the two essential elements of the invention, the bend die and the bending jaw.
Figure 28:
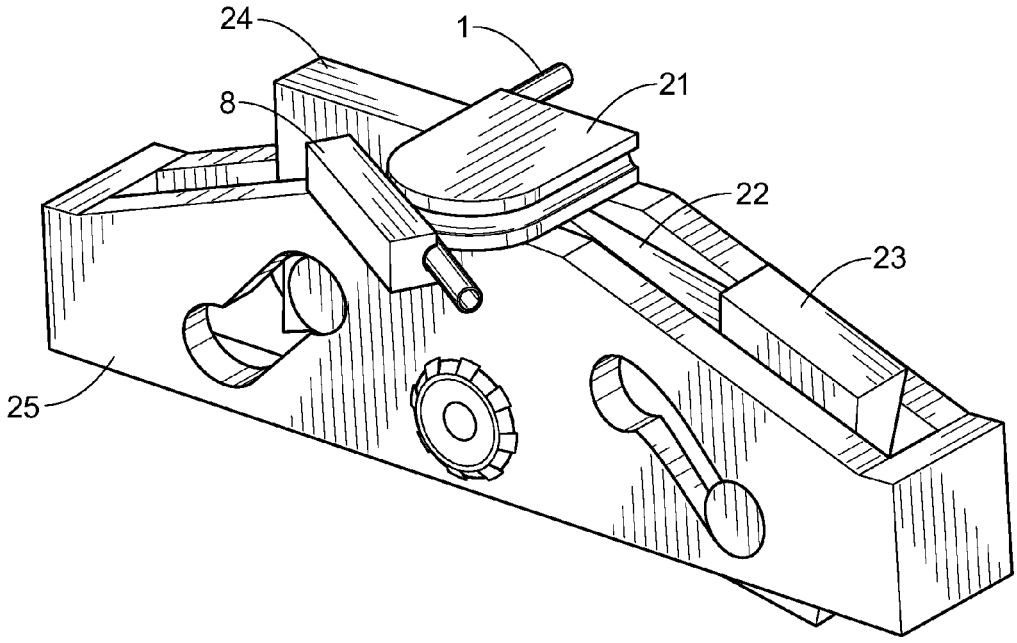
FIG. 28 shows an alternate perspective view of the invention.

The two essential elements of the bending machine according to the invention are depicted schematically in FIG. 3. The bend die 7 is a double die in this depiction and the bending jaw 8 is of a specific prismatic shape. The bend die may or may not be symmetric. According to an alternative form of the invention which is illustrated in FIG. 28, the use of a single bend die with a special clamping device is also envisioned.

As has been depicted in FIG. 3, the double bend die 7 allows folding in the clockwise or counterclockwise direction according to the position of the bending jaw 8, the tube that is to be deformed being positioned in the middle of the double die and held within it.

The bending jaw 8 is prismatic and machined to the radius of the tube on at least one of its faces. Advantageously, the jaw will be machined on both lateral faces 9, 10 so as to allow folds in both the two possible directions in the plane of the bend die. The interior shape of the jaw 8 is, on the whole, concave and advantageously of a complementary shape with dimensions adapted to mate with the semicircle of the bend die.

By configuring the bending jaw 8 in this way, it is possible to position it as close as possible to the bend die and therefore perform successive bending operations with very short straight segments in-between.

Figure 4:
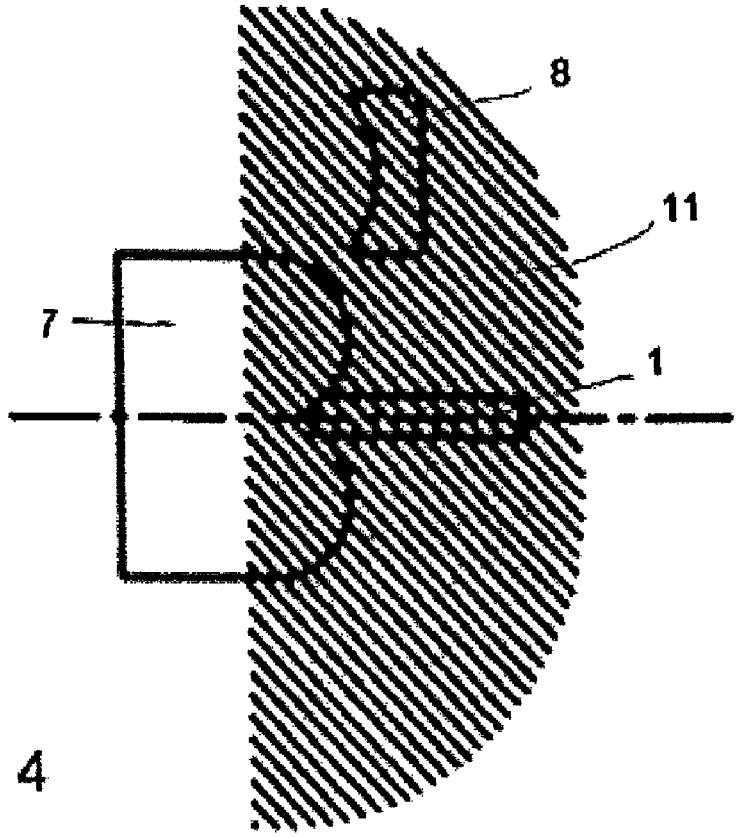
FIG. 4 shows a schematic view of the space in the horizontal plane in which the bending jaw can move during the bending operations.
Figure 5:
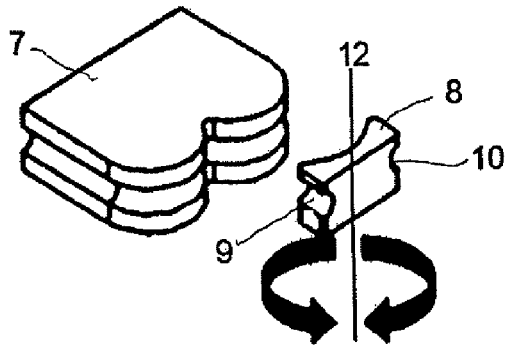
FIGS. 5 and 6 are perspective views, depicting the possible movements of the bending jaw in rotation and along the vertical axis.
Figure 6:
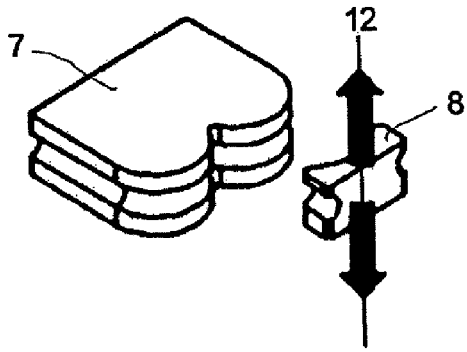

The bending jaw according to the invention also has the special feature of being positionable in a great many configurations:

- in the plane passing through the two bend dies, the dynamics governing the movement of the jaw 8 lie in a peripheral area 11 shown in hatching in FIG. 4, this movement being brought about by a combination of at least two movements, rectilinear and rotary,
- the bending jaw 8 is also orientable in rotation about an axis 12 passing through it in its central part and lying perpendicular to the plane of the two dies and therefore to the bending plane, as has been depicted in FIG. 5, and
- the bending jaw 8 is able to move in the vertical direction, along the axis 12, to allow multiple bending operations as has been illustrated in FIG. 6.

To sum up, the bending jaw 8 can move in three dimensions around the bend die and adopt numerous positions in order to carry out the bending operations.

FIGS. 7 to 27 illustrate special cases of bending operations and specific embodiments.

Figure 7:
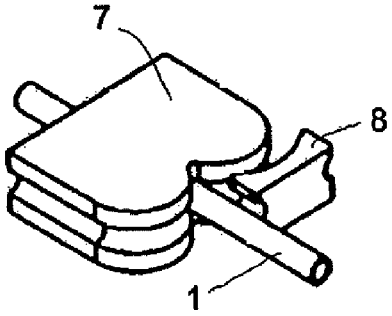
FIGS. 7, 8 and 9 illustrate perspective views of a conventional bending operation in the clockwise direction.
Figure 8:
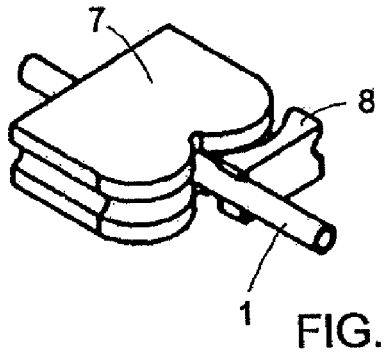
Figure 9:
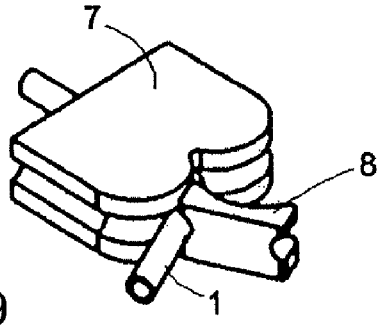

FIGS. 7 to 9 show a bending operation in the clockwise direction with the bending jaw being fixed very close to the bend die.

Figure 10:
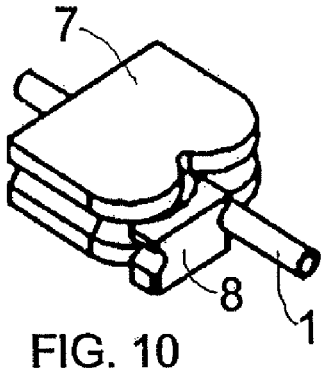
FIGS. 10 and 11 show perspective views of a bending operation in the counterclockwise direction.
Figure 11:
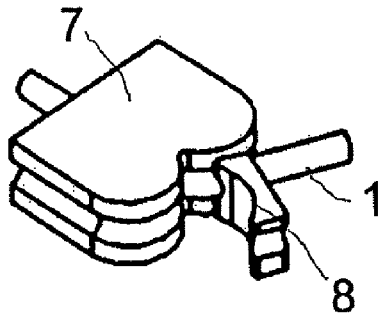

FIGS. 10 and 11 show the positioning of the jaw 8 for bending in the counterclockwise direction, and the position of said jaw 8 at the end of bending.

Figure 12:
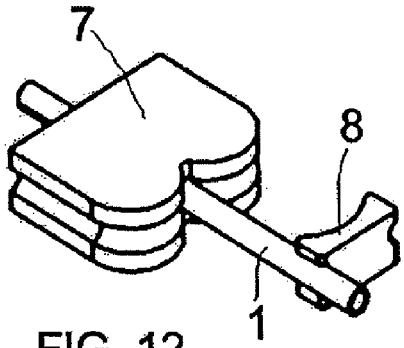
FIGS. 12 and 13 show perspective views of large-angle bending on a machine according to the invention.
Figure 13:
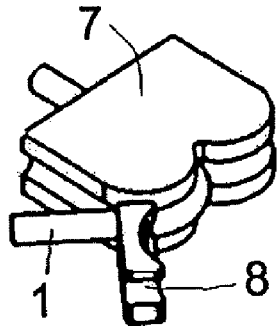

FIGS. 12 and 13 show a movement of the bending jaw 8 along the axis of the tube 1, so the winding around the die is accordingly more pronounced.

Figure 14:
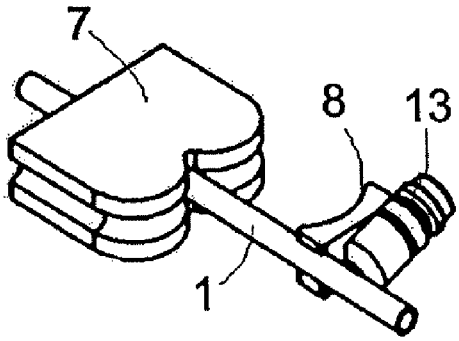
FIGS. 14 and 15 depict perspective views of the bending of a tube that has auxiliary components on it.
Figure 15:
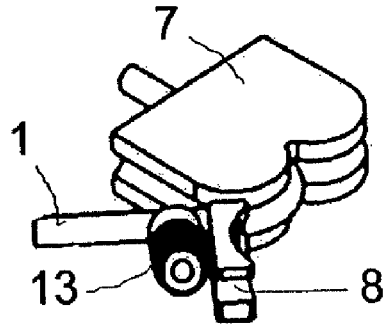

FIGS. 14 and 15 show an example of bending that takes account of an auxiliary component 13 positioned on the tube. Examples of auxiliary components that the tubes might bear before they are bent are flanges, valves, unions, etc. In this example, the jaw 8 maintains its position with respect to the auxiliary component throughout the bending operation by describing a circular arc.

Figure 16:
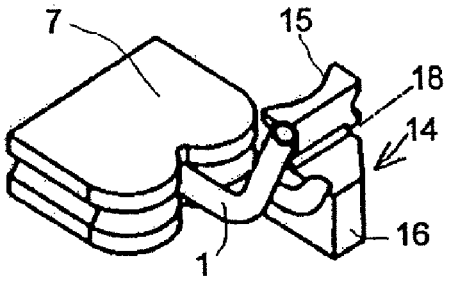
FIGS. 16, 17 and 18 show perspective views bending with a two-level bending jaw that allows there to be a minimum length of straight segment, or even none at all, between two bends.
Figure 17:
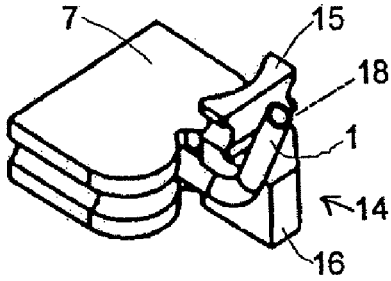
Figure 18:
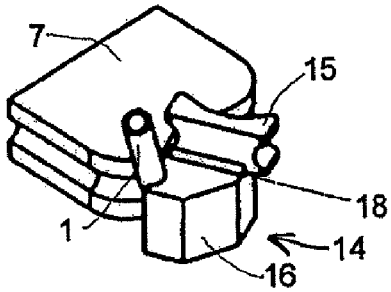

FIGS. 16 to 18 illustrate a bending operation using a two-level bending jaw 14 able to accommodate the previous bend so that a minimum straight segment can be left between bends. A recess made in the bend die may also be anticipated in the case of sequenced or nested bends.

According to the invention, the jaw can move rotationally about its central axis 12 and along this same vertical axis. In fact, it is advantageous to position various machined shapes on the sides of the jaw so that various bending operations can be performed using the same jaw. Advantageously, a means allowing the unused part or parts of the jaw to be kept clear in order to perform the next bending operation may be envisioned.

As has been depicted in FIGS. 16 to 18, a two-level bending jaw 14 may have one level 15 used in the first bending operation and a second level 16 in the vertical direction, used for a second folding operation once said level 15 has been retracted and the jaw 14 has been moved upward.

This retraction of one or more levels can be achieved in various ways, for example by pivoting the level about an axis 18.

By combining the various options for moving the bending jaw with those of a jaw that has several levels, a great many bending operations can be performed using a single part.

According to the invention, the bending machine may comprise a jaw that has at least one retractable facet, and said retractable facet is retracted by tilting or pivoting about an articulation positioned on the jaw itself.

Figure 19:
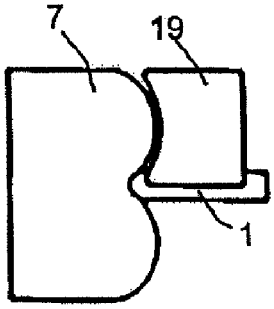
FIGS. 19, 20 and 21 depict schematic views of the specific movement of the bending jaw when bending a delicate tube.
Figure 20:
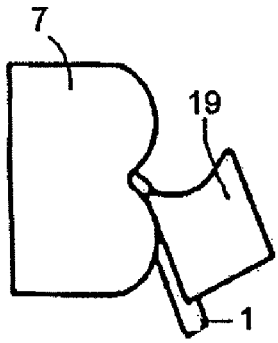
Figure 21:
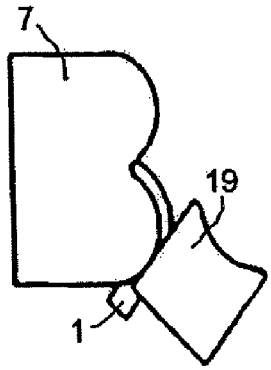

FIGS. 19 to 21 show an alternative form of the invention in which the way in which the tube behaves while it is being bent means that free winding of the tube will not be tolerated. For example, there are situations where there is a risk of a thin-walled tube rippling or breaking. It is advantageous to manufacture a very long bending jaw 19 that will hold the tube 1 during bending.

In this example, the bending jaw 19 performs a rocking movement remaining tangential to the curvature of the bend so that there is no slippage of this bending jaw with respect to the bent tube.

According to the invention, the jaw can move in an area peripheral to the double bend die, and this is particularly advantageous when there are obstacles on the part that is to be produced and when the bending needs to be particularly pronounced. In situations such as this, depicted by FIGS. 22 to 27, it is possible to move the jaw and perform the bending operation in successive small-angled sequences, these sequences being determined by the developed length that the length of the bending jaw will allow.

The invention also relates to a method of bending a tube using a machine as described hereinabove, in which the jaw is moved at least once along said tube during the shape forming operation, it being possible for the jaw to be moved in an area 11 peripheral to the bend die.

To carry out various bending operations, the jaw can be moved in a vertical direction or rotationally about a vertical axis passing through it, at right angles to the bending plane, or in a combination of the aforementioned two movements.

Figure 22:
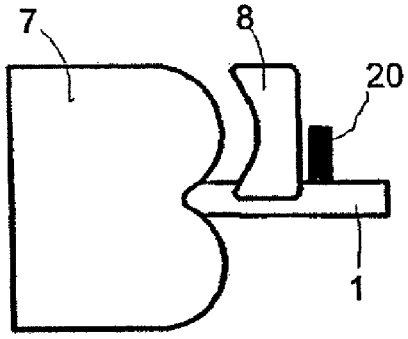
FIGS. 22 to 27 illustrate schematic views of the various sequences involved in bending a delicate tube that comprises an auxiliary component.
Figure 23:
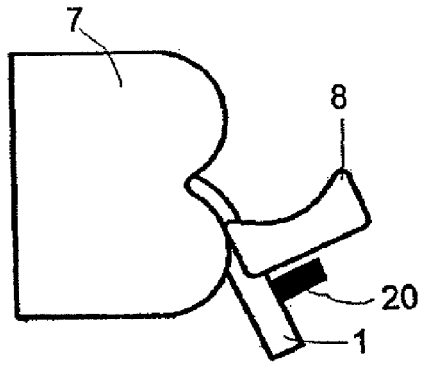
Figure 24:
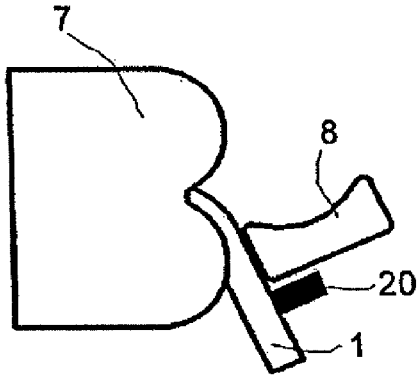
Figure 25:
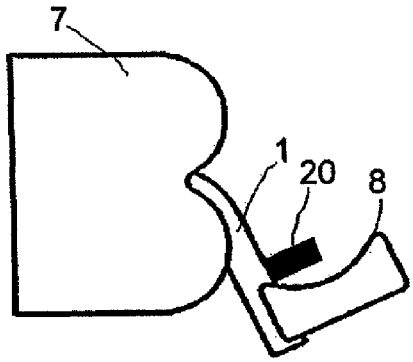
Figure 26:
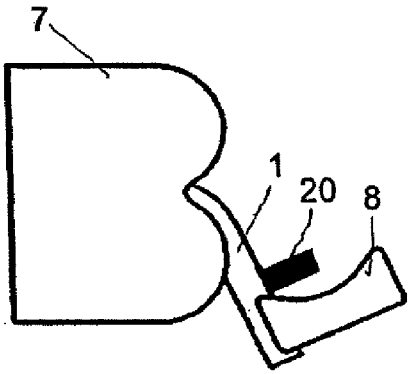
Figure 27:
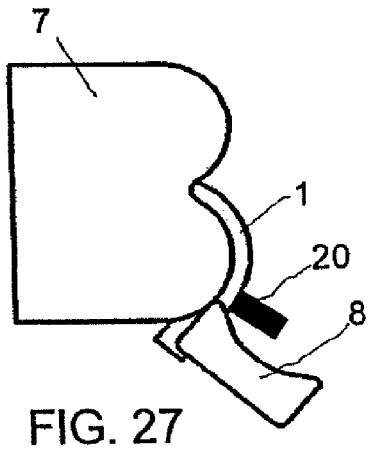

One example of the way in which the jaw moves during bending is illustrated in FIGS. 22 to 27. FIGS. 22 and 23 depict the bending of the first sector of a tube 1 comprising an obstacle 20. FIGS. 24 and 25 depict the disengagement of the jaw 8 and its repositioning on the tube after the obstacle 20. Finally, FIGS. 26 and 27 illustrate the bending of the second sector.

An important alternative form of the invention is depicted in FIG. 28. This alternative form involves providing a simple bend die that may or may not be symmetric, and may or may not comprise various levels, 21 together with a device for clamping the tube 1. The device for clamping is mounted on a rocking beam 22 and comprises two clamping jaws which may be straight or which may be in a shape that may or may not be made up of levels 23 and 24.

The bending jaws 23 and 24 may themselves be equipped with bend dies, in order thus to increase the number of possible combinations.

Just as in the examples that use a double bend die, the bending jaw 8 is prismatic and machined to the radius of the tube on at least one of its faces, the dynamics governing the movement of the bending jaw taking place in an area peripheral to the bend die and the jaw is orientable both in rotation and in terms of movement on a vertical axis.

All the options described in the aforementioned examples with a double bend die are still valid with this specific clamping system.

This alternative form allows the use of a single bend die that works in either direction according to the desired bend radius or direction. The clamping jaws 23 and 24 allow clamping alternatively to the right or to the left, and the rocking device allows the inoperative jaw to be retracted completely out of the working area to allow bends of up to 180 to be achieved.

The rocking beam 22 comprises two wrist pins that guide the rocking beam and its path in a form 25 which form 25 comprises cheeks in order to ensure precisely the desired movement.

The rocking beam 22 is driven by a crankshaft, wrist pin and square coupling piece assembly, the coupling piece sliding in a slot in the rocking beam.

In the depiction of FIG. 28, the rocking beam 22 has tilted to the right. The inoperative clamping jaw 23 lies below the working area, that is to say below the bending plane. The active clamping jaw 24 is holding the tube 1 firmly on the bend die 21 while the bending jaw 8 is performing bending as it moves in the peripheral space of the bend die 21. A deformation such as this can be performed through as much as 180.

There are numerous other alternative forms that the bending machine can adopt. For example, a simple or complex shaping of the bending jaw 8 may be envisioned, with one or more facets, which facets may be articulated to the jaw in various ways. A jaw made up of several levels may be provided, without departing from the scope of the invention.

There are various conceivable ways of moving the jaw in the region peripheral to the bend die and for orienting it in space.

The tubes, bars, wires or section pieces may be of varying sizes and natures without departing from the scope of the invention.

Quite obviously it is conceivable for bending operations that are more complicated that those described in the examples to be performed, for example with numerous repositionings of the jaw during the method of forming an element.

The machine that has the features of the invention may incidentally be numerically controlled or otherwise.

Of course, the invention is not restricted to the embodiments described and depicted by way of examples but also encompasses all technical equivalents and combinations thereof.

I claim:

1. An apparatus for cambering, forming, folding or bending a longitudinal member with a circular cross-section, the apparatus comprising:

a bending die having a clamp cooperative therewith, said bending die having a channel therein so as to orient the longitudinal member; and a bending jaw of a prismatic shape, said bending jaw having a channel formed on at least one face thereof, said channel having a size corresponding to a radius of the longitudinal member, said bending jaw being movable in at least two steps, one of the steps being rectilinear, another of the steps being rotary, said bending jaw movable in an area peripheral to said bending die, said bending jaw being rotatable relative to said bending die in the rotary step about a central axis perpendicular to a bending plane of the longitudinal member, said bending jaw being movable relative to said bending die in the rectilinear step in a vertical direction so as to allow for multiple bends of said longitudinal member, said clamp being carried by a rocking beam, said rocking beam carrying a pair of clamping jaws, said pair of clamping jaws suitable for clamping the longitudinal member on each side of said bending die alternatively such that when one of said pair of clamping jaws clamps the longitudinal member the other of said pair of clamping jaws lies outside a bending plane of the longitudinal member.

2. The apparatus of claim 1, said bending jaw being movable in the area peripheral to said bending die such that the channel of said bending jaw grips the longitudinal member.

3. The apparatus of claim 2, the longitudinal member being a tube having an auxiliary component extending outwardly therefrom.

4. The apparatus of claim 2, said bending jaw having at least one facet machined vertically above said channel thereof.

5. The apparatus of claim 4, said bending jaw having at least one retractable level.

6. The apparatus of claim 5, said retractable level being pivotally retractable.

7. The apparatus of claim 1, said bending die being a double die that is movable in a clockwise direction and movable in a counterclockwise direction.

* * * * *